US006979946B2

(12) United States Patent
Ohkubo

(10) Patent No.: US 6,979,946 B2
(45) Date of Patent: Dec. 27, 2005

(54) ELECTRODELESS FLUORESCENT LAMP

(75) Inventor: Kazuaki Ohkubo, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 176 days.

(21) Appl. No.: 10/479,016

(22) PCT Filed: Nov. 28, 2002

(86) PCT No.: PCT/JP02/12463

§ 371 (c)(1),
(2), (4) Date: Nov. 25, 2003

(87) PCT Pub. No.: WO03/046946

PCT Pub. Date: Jun. 5, 2003

(65) Prior Publication Data

US 2004/0155566 A1 Aug. 12, 2004

(30) Foreign Application Priority Data

Nov. 29, 2001 (JP) ..... 2001-364061

(51) Int. Cl.[7] ..... H01J 1/62
(52) U.S. Cl. ..... 313/485; 313/634; 313/489
(58) Field of Search ..... 313/244, 568, 313/634, 635, 160, 161, 594, 607, 483, 485, 313/486, 491, 493, 487, 489; 315/248; 427/66, 427/67

(56) References Cited

U.S. PATENT DOCUMENTS 4,010,400 A * 3/1977 Hollister ..... 315/248
5,105,122 A * 4/1992 Konings et al. ..... 313/487
5,621,266 A * 4/1997 Popov et al. ..... 313/46
5,783,912 A * 7/1998 Cocoma et al. ..... 315/248
5,796,208 A * 8/1998 Girach ..... 313/493
5,917,291 A * 6/1999 Soules et al. ..... 315/248
6,617,781 B2 * 9/2003 Murazaki et al. ..... 313/486
6,661,164 B2 * 12/2003 Ruemmelin et al. ..... 313/112
6,768,254 B2 * 7/2004 Arakawa et al. ..... 313/493
6,891,323 B2 * 5/2005 Lima et al. ..... 313/490

FOREIGN PATENT DOCUMENTS

JP 8-45481 A 2/1996

OTHER PUBLICATIONS

International Search Report for PCT/JP02/12463 mailed Feb. 4, 2003, ISA/JPO.

* cited by examiner

*Primary Examiner*—Edward J. Glick
*Assistant Examiner*—Elizabeth Keaney
(74) *Attorney, Agent, or Firm*—Harness, Dickey & Pierce, P.L.C.

(57) ABSTRACT

The thickness of a luminophor film (16') provided on the inner surface of a translucent discharge vessel (11) having a cavity portion (12) in which a light emitting substance is enclosed is the maximum in the vicinity of a plasma (15), becomes smaller as being closer to a connection portion (21) with an inner tube (32) and becomes also smaller as being closer to a round bottom portion (41). With this film thickness distribution, an electrodeless fluorescent lamp having approximately the same luminous intensity distribution characteristics as those of an incandescent lamp can be achieved. Therefore, even when the electrodeless fluorescent lamp is connected to an incandescent lamp lighting fixture, light can be taken out in a preferable state.

13 Claims, 9 Drawing Sheets

ELECTRODELESS FLUORESCENT LAMP

TECHNICAL FIELD

The present invention relates to electrodeless fluorescent lamps, and more particularly relates to an electrodeless fluorescent lamp in which a coil is disposed in a cavity portion of a discharge vessel.

BACKGROUND ART

In recent years, to cope with the problem of global warming and promote effective use of energy resources, efforts to reduce energy consumption have been made in various fields. In the filed of illumination, known incandescent lamps are being shifted to fluorescent lamps with higher energy efficiency, and recently the latter has become widely used.

However, there has been a problem in replacing an incandescent lamp with a fluorescent lamp. That is, an economical incandescent lamp lighting fixture also has to be changed to an expensive lighting fixture with a built-in ballast for operating a fluorescent lamp.

To solve this problem, an incandescent-lamp-substituting fluorescent lamp which can be directly connected to an incandescent lamp socket in an incandescent lamp lighting fixture and includes a base and a ballast has been developed. The incandescent-lamp-substituting fluorescent lamp can be used with an incandescent lamp lighting fixture in place of an incandescent lamp and consumes less power. Moreover, the lifetime of the incandescent-lamp-substituting fluorescent lamp is over three times as long as that of an incandescent lamp. For the above-described reasons, the incandescent-lamp-substituting fluorescent lamp has now been widely used.

On the other hand, for the purpose of further increasing the lifetime of fluorescent lamps, there has been developed an electrodeless fluorescent lamp in which no electrode, causing loss of the lifetime of a fluorescent lamp, is provided. In the electrodeless fluorescent lamp, a high-frequency alternating electromagnetic filed is applied from the outside to a closed glass discharge vessel in which a noble gas and mercury are enclosed and a luminophor is applied to the inside wall, so that mercury vapor discharge is generated within the discharge vessel. Thus, ultraviolet radiation resulting from the mercury vapor discharge excites the luminophor to make it emit light. In this manner, the electrodeless fluorescent lamp is based on a different light emitting principle to the principle on which known fluorescent lamp including an electrode is operated. With the electrodeless fluorescent lamp, it is possible to achieve lifetime over twice as long as that of a known electrode-included fluorescent lamp.

As an electrodeless fluorescent lamp, an electrodeless fluorescent lamp including a base, a coil for generating a high-frequency alternating electromagnetic filed, a ballast circuit through which an alternating current flows, and the discharge vessel which does not include an electrode has been developed for the purpose of providing substitutes for incandescent lamps.

Such an incandescent-lamp-substituting electrodeless fluorescent lamp (which will be hereinafter referred to as an "electrodeless compact self-ballasted fluorescent lamp") is assumed to be connected to an incandescent lamp lighting fixture. Thus, the electrodeless compact self-ballasted fluorescent lamp is required to have substantially the same shape and size as those of incandescent lamps. Recently, an electrodeless compact self-ballasted fluorescent lamp having close shape and size to those of incandescent lamps has been achieved.

Problems to be Solved

However, an incandescent lamp and an electrodeless compact self-ballasted fluorescent lamp are based on different light emitting principles. Therefore, luminous intensity distributions are different between the incandescent lamp and the electrodeless compact self-ballasted fluorescent lamp. Their respective luminous intensity distributions are shown in FIGS. 4 and 5. FIG. 4 is a graph showing characteristics of the luminous intensity distribution of a 60-watt silica incandescent lamp having an A type shape. FIG. 5 is a graph showing characteristics of the luminous intensity. distribution of a known electrodeless compact self-ballasted fluorescent lamp having also an A type shape. In each of FIGS. 4 and 5, the characteristics of the luminous intensity distribution of the incandescent lamp or the electrodeless compact self-ballasted fluorescent lamp when the lamp is placed with its base up are shown, and the upper side is the base side. Herein, the A type shape is a shape defined in JIS C7710-1988: Designation Method for Glass Bulbs of Lamps or in IEC 60887-1988. Note that IEC is an abbreviation of International Electrotechnical Commission.

Hereinafter, the respective light emitting principles on which the incandescent lamp and the electrodeless compact self-ballasted fluorescent lamp are based and differences between the respective luminous intensity distribution characteristics of the incandescent lamp and the known electrodeless compact self-ballasted fluorescent lamp due to differences between the principles on which the lamps are based will be described.

First, the respective light emitting principles on which the incandescent lamp and the electrodeless fluorescent lamp are based will be described.

In the case of the silica incandescent lamp, red heat irradiation from a filament located in the center of the lamp is diffused by a silica film applied to an outer tube.

On the other hand, the principle on which the known electrodeless compact self-ballasted fluorescent lamp is based is closely related to the structure of the lamp. Therefore, the principle used for the known electrodeless compact self-ballasted fluorescent lamp will be described as well as the structure of the known electrodeless compact self-ballasted fluorescent lamp shown in FIG. 8.

An A type shaped discharge vessel 11 made of soda glass includes an outer tube 31 and an inner tube 32 in which a cavity portion 12 having an approximately cylindrical shape is defined. In the cavity portion 12, a core 14 made of ferrite is disposed. Around the core 14, a coil 13 for generating an alternating electromagnetic field in the discharge vessel 11 is wound. A plasma 15 is generated by the generated alternating electromagnetic field. In this manner, the coil 13 and the core 14 are disposed to generate an alternating electromagnetic field and thereby the plasma 15 is generated in a ring shape so as to surround the coil 13 and the core 14 in the discharge vessel 11. An ultraviolet light generated by a discharge of the plasma 15 excites a luminophor film 16 evenly applied to the inside wall of the discharge vessel 11 to make the luminophor film 16 emit light. In this manner, visible light is generated. Note that the coil 13 is electrically connected to a ballast circuit 17 for supplying an alternating current to the coil 13, and then the ballast circuit 17 is electrically connected to a base 18 to be connected to the commercial power line. Moreover, a case 19 is provided so as to surround the ballast circuit 17, and the discharge vessel 11 and the base 18 are attached to the case 19. Note that for the purpose of simplification, the cross-section of each of the discharge vessel 11, the cavity portion 12 and the case 19 is indicated as a line.

Next, differences between the respective luminous intensity distribution characteristics of the incandescent lamp and the known electrodeless compact self-ballasted fluorescent lamp due to differences between the principles on which the lamps are based will be described.

As has been described, in the silica incandescent lamp, red heat irradiation from the filament located in the center of the lamp is diffused by the silica film applied to the outer tube. The light diffusion amount at the wall surface of the outer tube is small, and luminance is highest at a filament portion of the lamp. Moreover, the filament is located around the center of the curvature of the outer tube and the size of the filament is sufficiently smaller than the radius of the curvature. Thus, the silica incandescent lamp is considered to be a point light source whose center point is the filament. Accordingly, seen either from the side of the outer tube opposite to the base (i.e., an edge of the outer tube) or from the side face of the outer tube, the brightness of the tube seems almost the same. Therefore, as shown in FIG. 4, a substantially uniform luminous intensity distribution, except for vignetting of the base, is obtained. The luminous intensity distribution characteristics are the almost the same when the shape of the incandescent lamp is either an A type shape or a P type shape. Note that the P type shape is a shape defined in JIS C7710-1988: Designation Method for Glass Bulbs of Lamps or in IEC 60887-1988.

On the other hand, in the electrodeless fluorescent lamp, light is emitted out of the discharge vessel 11 of the electrodeless fluorescent lamp in the manner in which light emitted from the luminophor film 16 is repeatedly reflected inside of the of the discharge vessel 11 and part of the light transmits through the luminophor film 16. Because luminophor film 16 has a uniform thickness, the discharge vessel 11 is considered to be a light source having the entire surface with uniform luminance. In this manner, the electrodeless fluorescent lamp has uniform luminance at the entire surface, and thus the luminous intensity distribution is proportional to the apparent area of the surface. Accordingly, when the electrodeless compact self-ballasted fluorescent lamp having an A type shape and using the discharge vessel 11 is operated with its base up (in a base-up position), the apparent area of the lamp surface seen from directly under the lamp is smaller than that seen from the side (the lateral direction) and luminous intensity of light toward directly under the lamp is small, except for the case where the lamp seen from the base direction. The luminous intensity distribution characteristics have the same tendency as described above when the electrodeless compact self-ballasted fluorescent lamp has either an A type shape or a P type shape.

As in the description above, even if the silica incandescent lamp and the electrodeless fluorescent lamp have the same shape and size, the respective luminous intensity distributions of the lamps have different characteristics because the silica incandescent lamp and the electrodeless fluorescent lamp are based on different light-emitting principles.

Also, as an electrodeless reflector fluorescent lamp, which has a different shape from the A type shape and the P type shape, there has been studies of electrodeless fluorescent lamps in which a reflection film is provided in a region of the inner surface of an outer tube extending from the vicinity of a base to a portion of the outer tube having the maximum diameter (for example, see Japanese Unexamined Patent Publication No. 8-45481) or a reflector is provided in the same.

However, incandescent lamp lighting fixtures which have been widely used in present are designed so that light is taken out most efficiently when a lamp having the same luminous intensity distribution characteristics as those of an incandescent lamp is connected. Accordingly, even if the known electrodeless compact self-ballasted fluorescent lamp is connected to a widely-used lighting fixture, light can not be efficiently taken out because the electrodeless compact self-ballasted fluorescent lamp has different luminous intensity distribution characteristics from those of an incandescent lamp. In other respects than efficiency in taking light out, for example, when the electrodeless compact self-ballasted fluorescent lamp is connected to a lighting fixture located around the ceiling and used as a downlight, the tendency in which luminous intensity of light toward directly under the lamp is small as shown in FIG. 5 is further emphasized. As a result, an edge portion of the lamp unpreferably looks dark, compared to the periphery of the edge portion.

It can be another option to apply a material which absorbs light to part of the outer surface of the lamp in which the luminous intensity is high in order to control luminous intensity distribution characteristics, but the total luminous flux becomes small, resulting in reduction in efficiency. Therefore, this option is not practical.

Moreover, the electrodeless fluorescent lamp disclosed in the publication above does not have an incandescent lamp shape. Because of this difference in shape, the electrodeless fluorescent lamp can not be used as a substitute for an incandescent lamp. Furthermore, when the electrodeless fluorescent lamp is used with an incandescent table lamp to which the electrodeless fluorescent lamp can be connected with its base down, no light is taken out under the table lamp. Therefore, the electrodeless fluorescent lamp can not be used with such a table lamp with its base down (in a base-down position).

The present invention has been devised in view of the above-described problems and it is therefore an object of the present invention to provide an electrodeless fluorescent lamp which has approximately the same luminous intensity distribution characteristics as those of an incandescent lamp and is suited to an incandescent lamp lighting fixture.

DISCLOSURE OF INVENTION

A first electrodeless fluorescent lamp in accordance with the present invention includes: a translucent discharge vessel in which a light emitting substance is enclosed and which has a cavity portion; a coil which is disposed in the cavity portion and generates an alternating electromagnetic field for inducing discharge of the light emitting substance; and a luminophor film formed on an inside wall of the discharge vessel, and the discharge vessel includes an outer tube and an inner tube in which the cavity portion is defined, and the luminophor film has the maximum thickness in the vicinity of the intermediate point between a connection portion of the outer tube and the inner tube and part of the outer tube which is located most distant from the connection portion, and the thickness of part of the luminophor film becomes smaller as the part is closer to the connection portion from the point with the maximum thickness, whereby the luminophor film has a predetermined luminous intensity distribution characteristics.

In a preferred embodiment of the present invention, the predetermined luminous intensity distribution characteristics are substantially the same as those of an incandescent lamp.

A second electrodeless fluorescent lamp in accordance with the present invention includes: a translucent discharge vessel in which a light emitting substance is enclosed and which has a cavity portion; a coil which is disposed in the cavity portion and generates an alternating electromagnetic field for inducing discharge of the light emitting substance; and a luminophor film formed on an inside wall of the discharge vessel, and the coil has an approximately cylindrical shape, the discharge vessel includes an outer tube which includes a body potion and a neck portion having a reduced diameter and protruding from the body portion, and an inner tube in which the cavity portion is defined, the inner tube is connected to the neck portion and extends toward a round portion of the body portion which is located most distant from the neck portion, and the luminophor film has the maximum thickness in the vicinity of the intermediate point between a connection portion of the inner tube and the neck portion and the round bottom portion, and the thickness of part of the luminophor film becomes smaller as the part is closer to the connection portion and also as the part is closer to the round bottom portion.

It is preferable that the center axis of the coil extends in approximately the same direction as the direction in which the cavity portion caves in, and a plasma generated by the alternating electromagnetic field in the discharge vessel has a ring shape whose center point is a predetermined point located on the center axis of the coil and also in the coil.

It is preferable that assuming that the maximum thickness of the luminophor film is 1, the thickness of part of the luminophor film located in the round bottom portion of the outer tube is not less than 0.1 and not more than 0.8, and the thickness of part of the luminophor film located in the vicinity of the connection portion with the inner tube is not less than 0.5 and not more than 0.8.

It is preferable that the maximum thickness of the luminophor film is not less than 12 $\mu$m and not more than 24 $\mu$m, the thickness of part of the luminophor film located in the round bottom portion of the outer tube is not less than 7 $\mu$m and not more than 17 $\mu$m, and the thickness of part of the luminophor film located in the vicinity of the connection portion with the inner tube is not less than 8 $\mu$m and not more than 17 $\mu$m.

It is preferable that the luminophor film has the maximum thickness in the vicinity of part of the outer tube in which a circle of an intersection line between a plane perpendicularly intersecting with the center axis of the coil and the outer tube has the maximum size.

It is preferable that when the luminophor film is irradiated with ultraviolet light, in the relationship between the luminous intensity of radiation fluorescent light from the opposite surface of the luminophor film to the irradiated surface of the luminophor film and the thickness of the luminophor film, the maximum thickness of the luminophor film is larger than a thickness with which the luminous intensity is the maximum, and the average of the thickness of part of the luminophor film located in the round bottom and the average of the thickness of part of the luminophor film located in vicinity of the connection portion are smaller than a thickness with which the luminous intensity is the maximum.

Moreover, it is preferable that the shape of the discharge vessel is an A type shape or a P type shape defined in JIS C7710-1988: Designation Method for Glass Bulbs of Lamps or IEC 60887-1988.

In another preferred embodiment of the present invention, the electrodeless fluorescent lamp further includes: a core around which the coil is wound and which is made of ferrite; a ballast circuit for supplying an alternating current to the coil to generate an alternating electromagnetic field; a base which is electrically connected to the ballast circuit and receives power supply from the commercial power line; and a case which surrounds the ballast circuit and to which the discharge vessel and the base are attached.

Moreover, in still another preferred embodiment of the present invention, the electrodeless fluorescent lamp further includes a lighting fixture which reflects light from the electrodeless fluorescent lamp.

BEST MODE FOR CARRYING OUT THE INVENTION

An embodiment in accordance with the present invention will be described with reference to the accompanying drawings.

Figure 1:
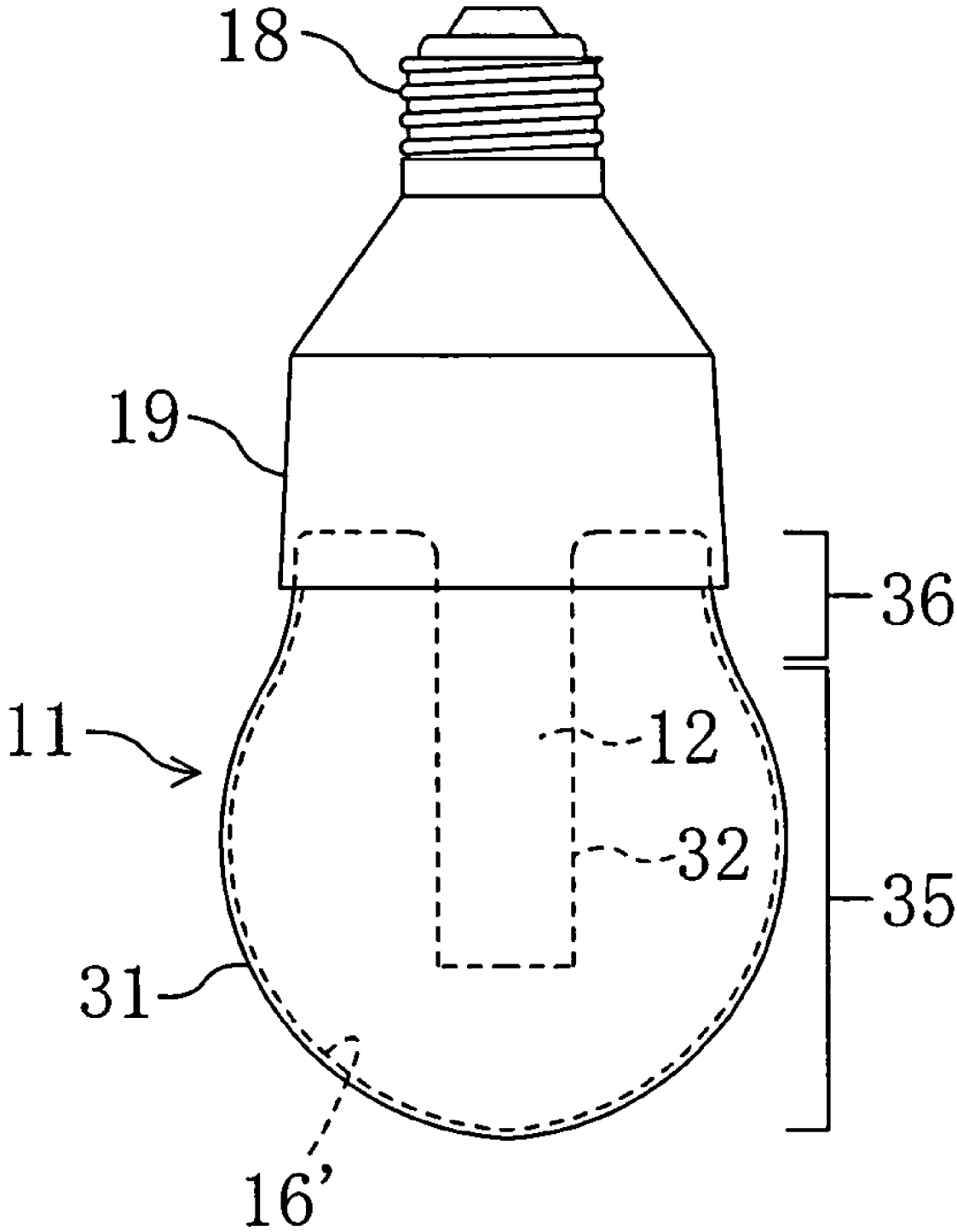
FIG. 1 is an illustration of the external appearance of an electrodeless fluorescent lamp in accordance with an embodiment of the present invention.

Seen from the outside, as shown in FIG. 1, an electrodeless fluorescent lamp of this embodiment includes a discharge vessel 11 in which a luminophor film 16' is formed on the inside wall, a case 19 connected to the discharge vessel 11 and a base 18 connected to the side of the case 19 opposite to the side thereof on which the discharge vessel 11 is connected. The discharge vessel 11 includes an outer tube 31 and an inner tube 32 in which a cavity portion 12 is defined. The outer tube 31 has a pot shape or a pear shape and includes an approximately globular body portion 35 and a neck portion 36 having a reduced diameter and protruding from the body portion 35.

Figure 2:
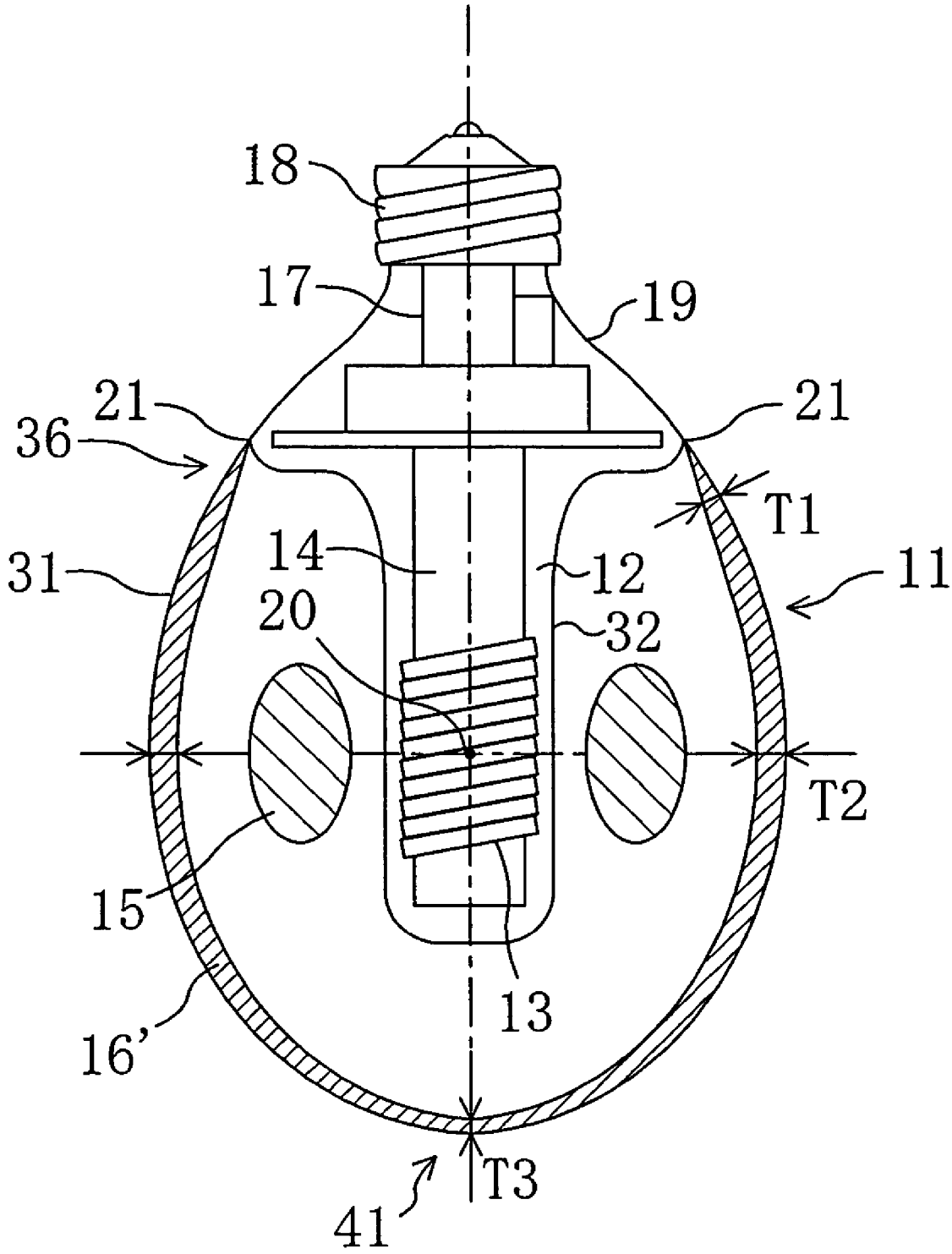
FIG. 2 is a cross-sectional view schematically illustrating the electrodeless fluorescent lamp in the embodiment of the present invention.

As shown in FIG. 2 as a detail schematic cross-sectional view, in the electrodeless fluorescent lamp of this embodiment, a coil 13 wound around a core 14 is disposed in the cavity portion 12 and the coil 13 is connected to a ballast circuit 17 located in the case 19. The detail structure of the electrodeless fluorescent lamp will be described.

The discharge vessel 11 is made of translucent soda glass. A light emitting substance (e.g., mercury and a noble gas such as argon and xenon) is enclosed in a space surrounded by the outer tube 31 and the inner tube 32 in the discharge vessel 11. The inner tube 32 is connected to the neck portion 36 of the outer tube 31 and extends toward a round bottom portion 41 of the outer tube 31. The reference numeral 21 denotes a connection portion between the inner tube 32 and the neck portion 36. The round bottom portion 41 of the outer tube 31 is part of the spherical surface of the discharge vessel 11 which becomes a lower edge portion of the lamp when the lamp is placed with the neck portion 36 of the outer tube 31 up and also part of the outer tube 31 which is located most distant from the neck portion 36. Note that precisely, the shape of the discharge vessel 11 herein is an "A type shape" defined in JIS C7710-1988: Designation Method for Glass Bulbs of Lamps or IEC 60887-1988.

In the cavity portion 12, the columnar core 14 made of ferrite is disposed. The coil 13 wounded around the core 14 has an approximately cylindrical shape. The direction in which the center axis of the coil 13 extends is approximately the same direction as the direction in which the cavity portion 12 caves in. The coil 13 is electrically connected to the ballast circuit 17 and an alternating current flows from the ballast circuit 17 to the coil 13. The ballast circuit 17 is electrically connected to the base 18 which receives power supply from the commercial power line. The base 18 is connected to an incandescent lamp socket. Moreover, the case 19 is provided so as to surround the ballast circuit 17 and the discharge vessel 11 and the base 18 are attached to the case 19.

The coil 13 receives alternating current supply from the ballast circuit 17 to generate an alternating electromagnetic field in the discharge vessel 11. By the alternating electromagnetic field, a plasma 15 is generated in the discharge vessel 11. The coil 13 and the core 14 are disposed in the cavity portion 12 to generate an alternating electromagnetic field. Therefore, the plasma 15 is generated in the periphery of the coil 13 in the cavity portion 12 so as to have a ring shape whose center is a predetermined point 20 in the coil 13. The predetermined point 20 is located in a cylinder formed of the coil 13 and on the center axis of the coil 13. Note that the plasma 15 can be considered to be a discharge path.

Ultraviolet light generated from the plasma 15 due to discharge excites the luminophor film 16' applied to the inside wall of the discharge vessel 11 to make the luminophor film 16' emit light. The thickness of luminophor film 16' varies in parts thereof depending on where the parts are located on the inside wall of the discharge vessel 11, so that the lamp has predetermined luminous intensity distribution characteristics. Further detail description on this point will be made. Note that for the purpose of simplification, each of the cross-sections of the discharge vessel 11 and the case 19 are indicated by a line.

Subsequently, the relationship between the thickness of the luminophor film 16' and visible light emitted to the outside of the discharge vessel 11 will be described.

Figure 3A:
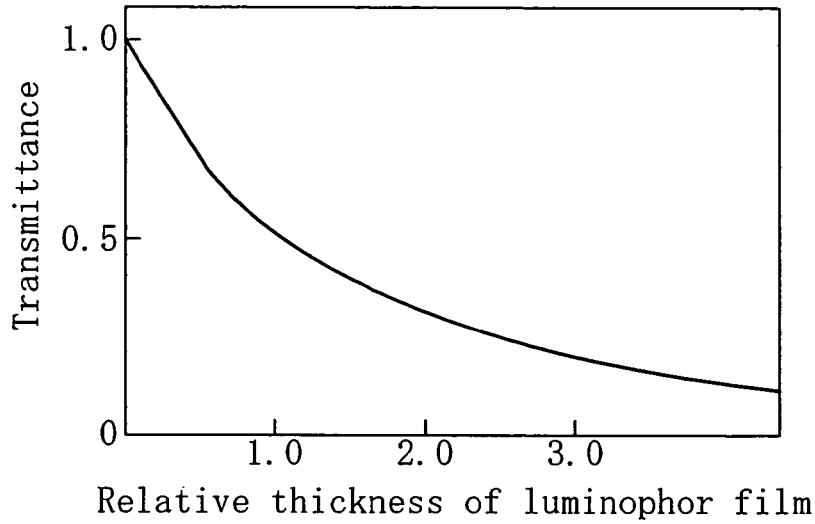
FIGS. 3(*a*) through 3(*c*) are graphs showing the relationships between the relative thickness and transmittance of a luminophor film and luminous intensity.
Figure 3B:
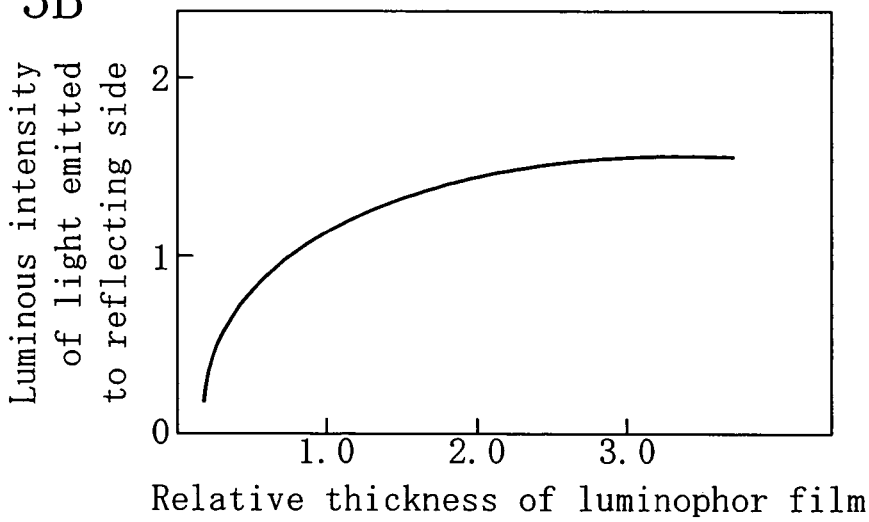
Figure 3C:
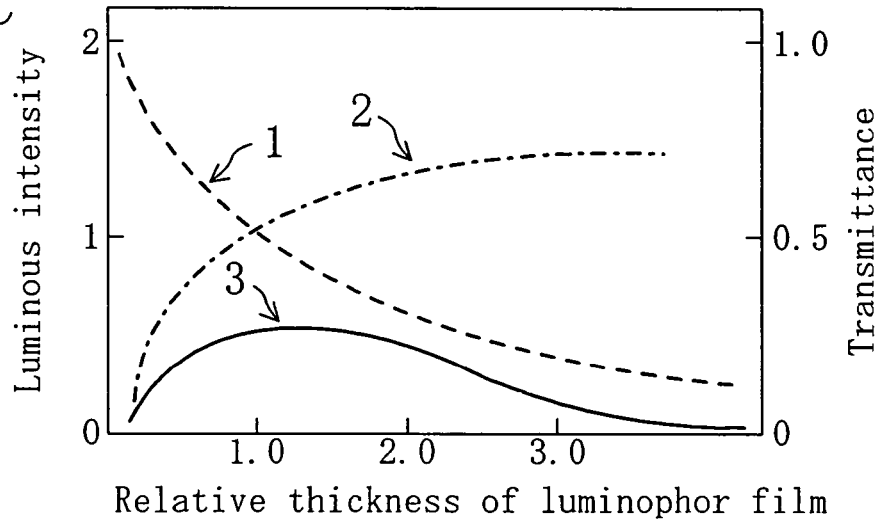

FIG. 3(*a*) is a graph showing the transmittance of light with respect to the relative thickness of a luminophor film. The abscissa indicates the relative thickness of the luminophor film and the ordinate indicates the transmittance of light. The relative thickness of the luminophor film is obtained by standardizing film thickness by letting the thickness of the luminophor film with which the transmittance of light is 50% be 1. Moreover, for the transmittance of light, light diffusion transmittance when vertical incidence of the light to a luminophor film is performed is used. As can be seen from FIG. 3(*a*), the transmittance of light transmitting through the luminophor film is reduced as the thickness of the luminophor film is increased. Note that when the type and size of a luminophor are different, the tendency of the curve of FIG. 3(*a*) is the same but the change rate of the curve varies.

Moreover, a luminophor of the fluorescent lamp is applied to the inner surface of the discharge vessel 11. The luminophor receives ultraviolet light at the surface thereof facing the inside of the discharge vessel 11 and thereby becomes excited to emit fluorescent light (visible light). The emitted fluorescent light can be divided, depending on the direction of the fluorescent light, into two types, i.e., fluorescent light emitted to the inside (reflecting side) of the discharge vessel 11 and fluorescent light emitted to the outside (transmitting side) of the fluorescent lamp.

Fluorescent light emitted to the reflecting side exhibits the characteristics shown in FIG. 3(*b*) with respect to the thickness of the luminophor. The abscissa indicates the relative thickness of the luminophor film. The ordinate indicates the luminous intensity of the light emitted to the reflecting side. The luminous intensity of light emitted to the reflecting side of the luminophor film is expressed by a relative value obtained by letting the luminous intensity of light emitted to the reflecting side when the relative film thickness of the luminophor film standardized in FIG. 3(*a*) is 1 be 1. With respect to ultraviolet light having a constant intensity, the luminous intensity of the fluorescent light emitted to the reflecting side is increased as the thickness of the luminophor film is increased. However, according to Beer's law, ultraviolet light is absorbed according to the thickness of the luminophor. Accordingly, ultraviolet light does not reach a certain depth or more of the luminophor film. Therefore, as shown in FIG. 3(*b*), the luminous intensity of the fluorescent light emitted to the reflecting side is saturated when the thickness of the luminous film is sufficiently large.

Figure 4:
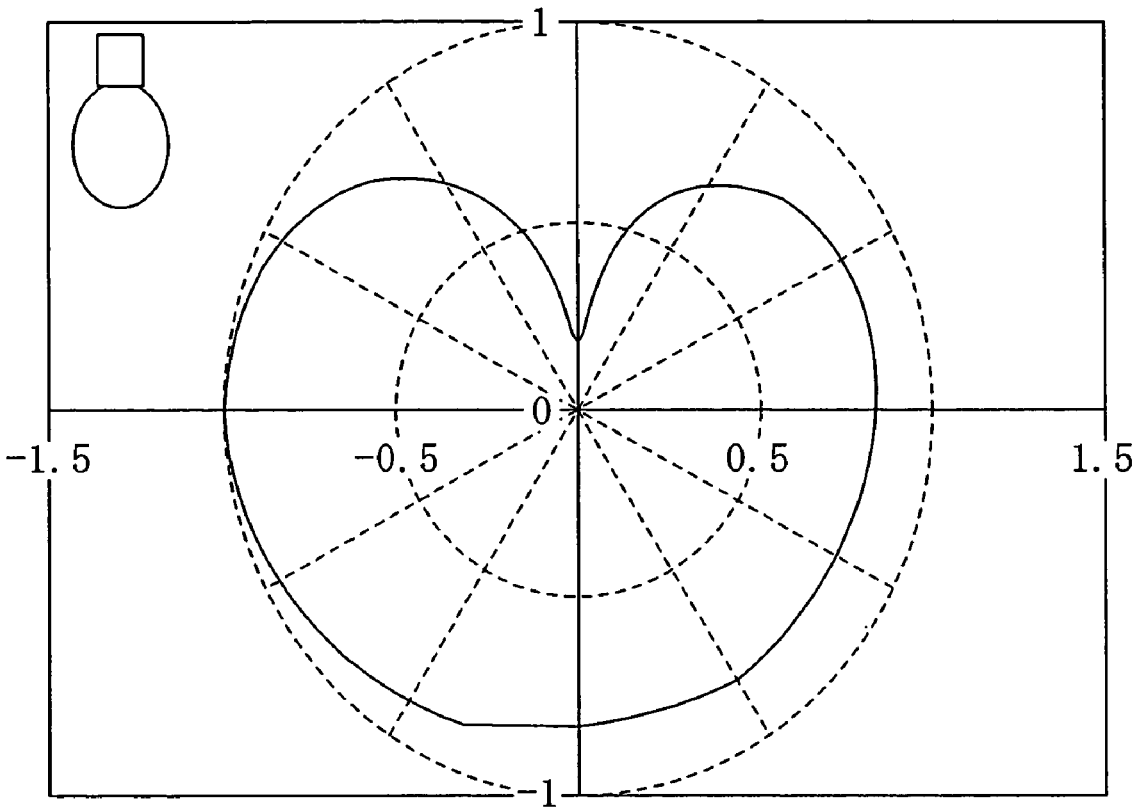
FIG. 4 is a graph showing characteristics of the luminous intensity distribution of an A type shaped silica incandescent lamp.
Figure 5:
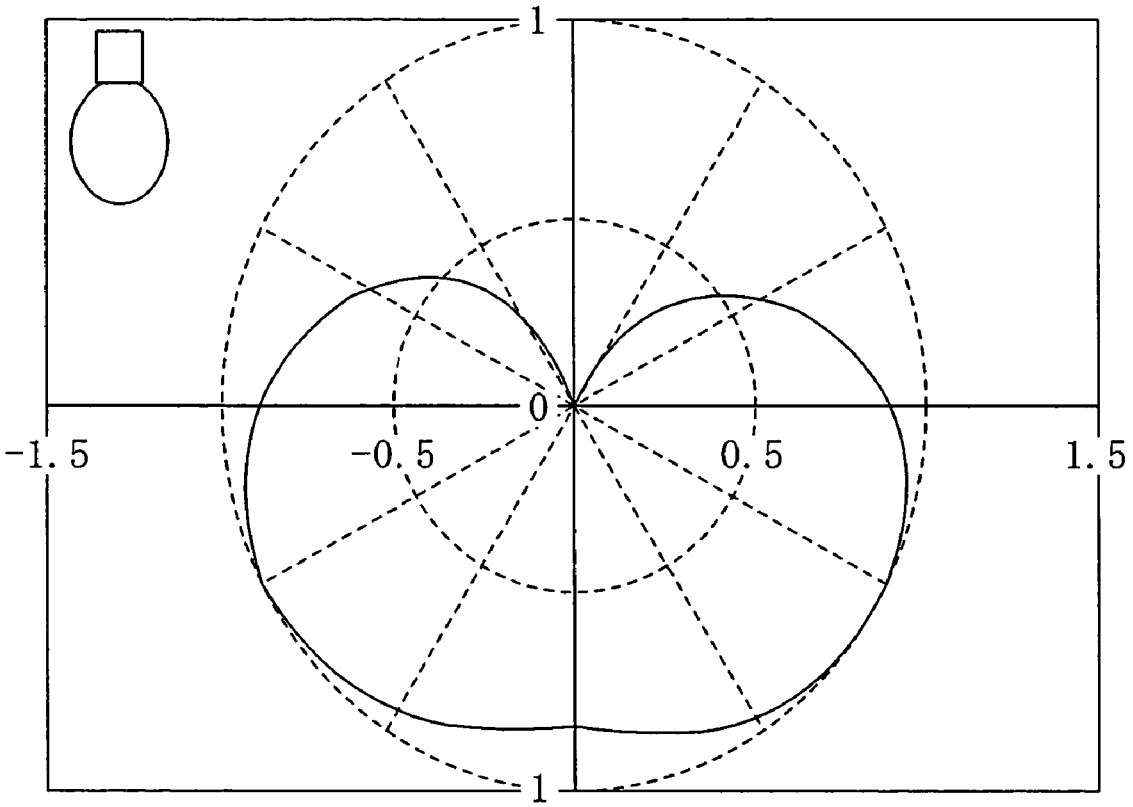
FIG. 5 is a graph showing characteristics of the luminous intensity distribution of a known incandescent-lamp-substituting electrodeless fluorescent lamp (having an A type shape).

Thus, to make the luminous intensity distribution of the electrodeless discharge lamp of FIG. 5 in which the luminophor film has a uniform thickness close to that of the incandescent lamp of FIG. 4, it is normally intended to increase luminance by increasing the thickness of the luminophor film at the round bottom portion 41 which is located most distant from the vicinity of the base 18 of the discharge vessel 11 or the base 18 and in which the luminous intensity is small, to a greater thickness than those of other parts thereof However, in the present invention, the luminous intensity of the fluorescent light emitted to the transmitting side to be described later is also taken into consideration, and the luminous intensity distribution characteristics of the lamp are made close to those of the incandescent lamp without reducing total luminous flux taken from the discharge vessel 11. Therefore, as will be described later, the thicknesses of parts of the luminophor film located in the vicinity of the base 18, and in the round bottom portion 41 are not increased.

The fluorescent light emitted to the transmitting side further transmits through the luminophor film to the outside, and thus the luminous intensity of the fluorescent light emitted to the transmitting side can be approximately expressed by the luminous intensity 3, as shown in FIG. 3(*c*), obtained by multiplying the luminous intensity 2 of the fluorescent light emitted to the reflecting side by the transmittance 1 of the luminophor film. With increase in the thickness of the luminophor film, the luminous intensity 3 of the fluorescent light emitted to the transmitting side is increased. However, the luminous intensity 3 of the fluorescent light emitted to the transmitting side reaches the maximum at a certain thickness. Then, after the thickness of the luminophor becomes over the certain thickness, the luminous intensity 3 of the fluorescent light emitted to the transmitting side is reduced as the thickness thereof is increased.

Figure 6:
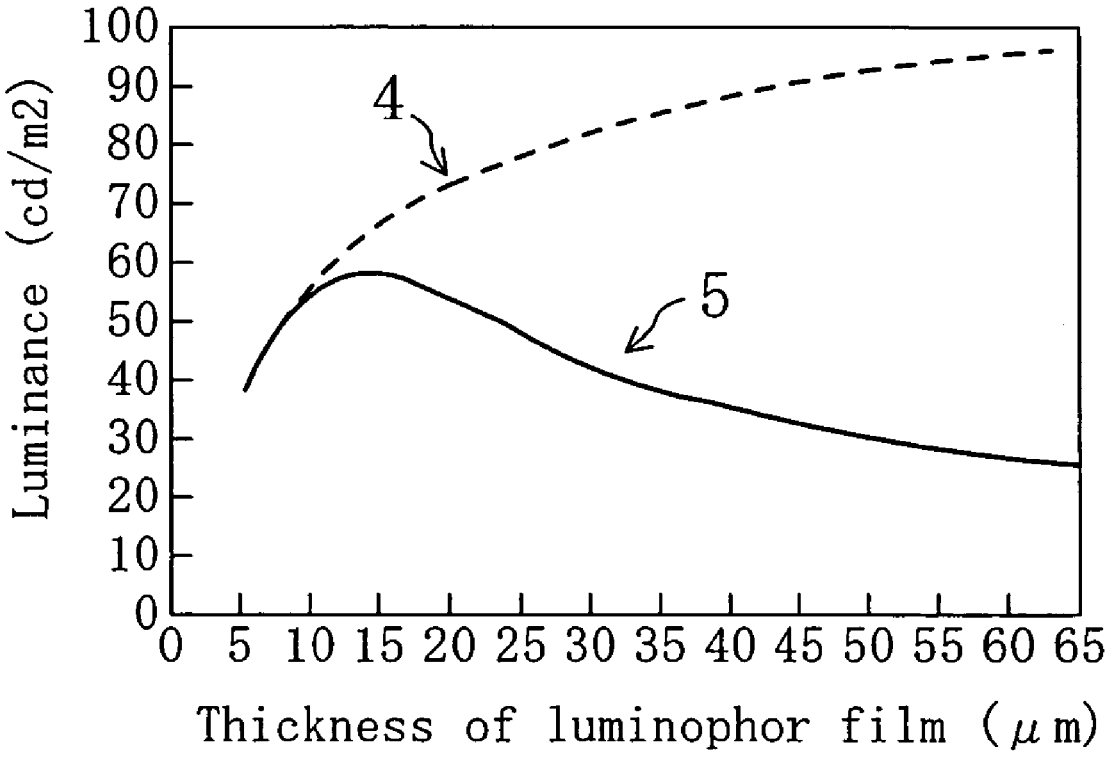
FIG. 6 is a graph showing the relationship between the thickness of and luminance of a luminophor film in the embodiment of the present invention.

FIG. 6 is a graph showing a relation curve of the luminance 4 of the fluorescent light emitted to the reflecting side and the luminance 5 of the fluorescent light emitted to the transmitting side with respect to the thickness of the luminophor film, based on actual measurements, when as a luminophor a mixture of a blue luminophor ($BaMg_2Al_{16}O_{27}$:Eu, Mn), a green luminophor ($LaPO_4$:Ce, Tb) and a red luminophor ($Y_2O_3$:Eu) is used. When the thickness of the luminophor film is about 14 $\mu$m, the luminance 5 of the fluorescent light emitted to the transmitting side is the maximum. In the electrodeless fluorescent lamp of this embodiment, this luminophor is used.

Since a fluorescent lamp is, in general, a closed space, the fluorescent light emitted to the reflecting side is divided into three types, i.e., fluorescent light to be reflected again at the inner surface of the discharge vessel 11, fluorescent light to be absorbed at the inner surface of the discharge vessel 11, and fluorescent light to transmit through the luminophor film 16' to the outside of the discharge vessel 11. Accordingly, the amount of fluorescent light taken out from a predetermined part of the luminophor film 16' to the outside of the fluorescent lamp is obtained by adding, to the amount of fluorescent light emitted to the transmitting side, a value obtained by multiplying, by the transmittance of the luminophor film 16', the amount of part of the fluorescent light emitted to the reflecting side and diffused in the discharge vessel 11 with which the predetermined part of the luminophor film 16' is irradiated again.

It can be understood from the description above that as for light emitted to the outside of the discharge vessel 11 in the electrodeless fluorescent lamp, the luminance of the light can be controlled by partially changing the thickness of the luminophor film 16'. To transform ultraviolet light generated from the plasma 15 to fluorescent light as much as possible, the thickness of the luminophor film 16' may be increased as much as possible. On the other hand, to emit light in the discharge vessel 11 to the outside thereof, the smaller thickness the luminophor film 16' has, the more light is emitted to the outside. Furthermore, in view of practical use, it is preferable that the total luminous flux of the electrodeless fluorescent lamp is not less than that in the case where a luminophor is evenly applied to the luminophor film.

In view of those described above, in this embodiment, as shown in FIG. 2, the luminophor film is applied so that the thickness T2 of part of the luminophor film located around the intermediate position between the connection portion 21 and the round bottom portion 41 is the maximum thickness throughout the luminophor film and the thickness of part of the luminophor film is smaller as the part is closer to the connection portion 21 and the thickness thereof is smaller as the part is closer to the round bottom portion 41. That is to say, in this embodiment, the thickness of the luminophor film is reduced at parts thereof corresponding to parts exhibiting a smaller luminous intensity than that of the counterparts of the incandescent lamp in the luminous intensity distribution of the known electrodeless fluorescent lamp of FIG. 5 in which the luminophor film is evenly applied.

Moreover, part of the luminophor film having the maximum thickness T2 is in the vicinity of part of the outer tube 31 in which a circle of an intersection line between a plane perpendicularly intersecting with the center axis of the coil 13 and the outer tube 13 has the maximum size. Furthermore, the part of the luminophor film having the maximum thickness T2 is also in the vicinity of the plasma 15. Herein, the vicinity of the plasma 15 is the vicinity of part (cross-sectional portion) of the discharge vessel 11 in which a plane inclusive of the predetermined point 20, i.e., the center of the plasma 15, and perpendicular to the center axis of the coil 13 intersects with the outer tube 31 of the discharge vessel 11. Substantially, the vicinity of the plasma 15 is a region of the discharge vessel 11 located between part of thereof in which a plane inclusive of a winding start potion of the coil 13 and perpendicular to the center axis of the coil 13 intersects with the outer tube 31 and part thereof in which a plane inclusive of a winding end potion of the coil 13 and perpendicular to the center axis of the coil 13 intersects with the outer tube 31. Moreover, the plasma 15 is stably generated in part of the discharge vessel 11 in which the diameter of the outer tube 31 in the perpendicular direction to the center axis of the coil 13 is the maximum. In other words, the luminophor film has the maximum thickness in the vicinity of part of the discharge vessel 11 in which the diameter of the outer tube 31 is the maximum.

The film thickness distribution of the luminophor film 16' will be further described.

As described above, the amount of ultraviolet light with which part of the luminophor film 16' located in the vicinity of the plasma 15 is irradiated is relatively larger than the amount of ultraviolet light with which the other parts rae irradiated. Therefore, the thickness of part of the luminophor film 16' in the vicinity of the plasma 15 is increased so that ultraviolet light is transformed to fluorescent light as much as possible. On the other hand, the thicknesses of parts of the luminophor film 16' located in the round bottom portion 41 and in the vicinity of the connection portion 21 are relatively small so that transmittance is increased. According to this, it can be qualitatively explained with the graph of the luminance of 5 of the light emitted to the transmitting side shown in FIGS. 3(*c*) and 6 that the thickness of part of the luminophor film located in the vicinity of the plasma 15 is preferably larger than a thickness with which the maximum luminance is obtained whereas the average of the thicknesses of parts of the luminophor film located in the vicinity of the connection portion 21 and in the round bottom portion 41 is preferably smaller than the thickness with which the maximum luminance can be obtained. Note that it is also important in practice to increase the total luminous flux as much as possible. Therefore, the thicknesses of the parts of the luminophor film located in the vicinity of the connection portion 21 and in the round bottom portion 41 may be larger than a thickness which the maximum luminance can be obtained.

If the thicknesses of the parts of the luminophor film 16' are numerically expressed, assuming the maximum thickness T2 of of the luminophor film 16' is 1, the thickness T3 of part of the luminophor film 16' located in the round bottom portion 41 of the outer tube 31 is not less than 0.1 and not more than 0.8 and the thickness T1 of part of the luminophor film 16' located in the vicinity of the connection portion 21 with the inner tube 32 is not less than 0.5 and not more than 0.8. In this embodiment, T1 is 0.8 and T3 is 0.5. Specifically, it is preferable that the maximum thickness T2 is not less than 12 $\mu$m and not more than 24 $\mu$m, the thickness T3 of the part of the luminophor film 16' located in the round bottom portion 41 of the outer tube 31 is not less than 7 μm and not more than 17 μm, and the thickness T1 of the part of the luminophor film 16' located in the vicinity of the connection portion 21 with the inner tube 32 is not less than 8 μm and not more than 17 μm. In this embodiment, T2 is 20 μm (the thickness of part of the luminophor film 16' in the vicinity thereof is 15–20 μm and the average of the thickness is 17 μm), T3 is 8–16 μm (the average is 12 μm) and T1 is 10–17 μm (the average is 15 μm). Herein, although not clearly shown in FIG. 2, the thickness of part of the luminophor film 16' in the vicinity of the connection portion 21 with the inner tube 32 is around the boundary between part of the discharge vessel 11 exposed to the outside and part of the case 19 not exposed to the outside.

Figure 7:
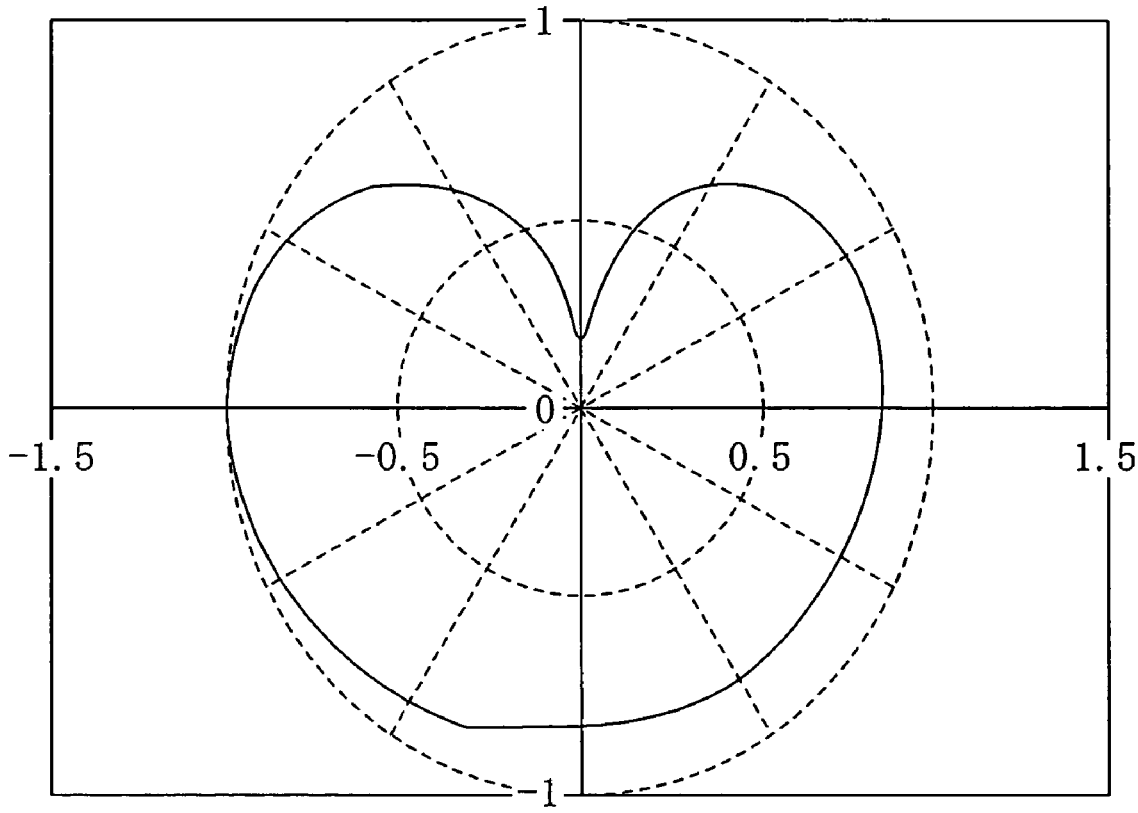
FIG. 7 is a graph showing characteristics of the luminous intensity distribution of the electrodeless fluorescent lamp in the embodiment of the present invention.
Figure 8:
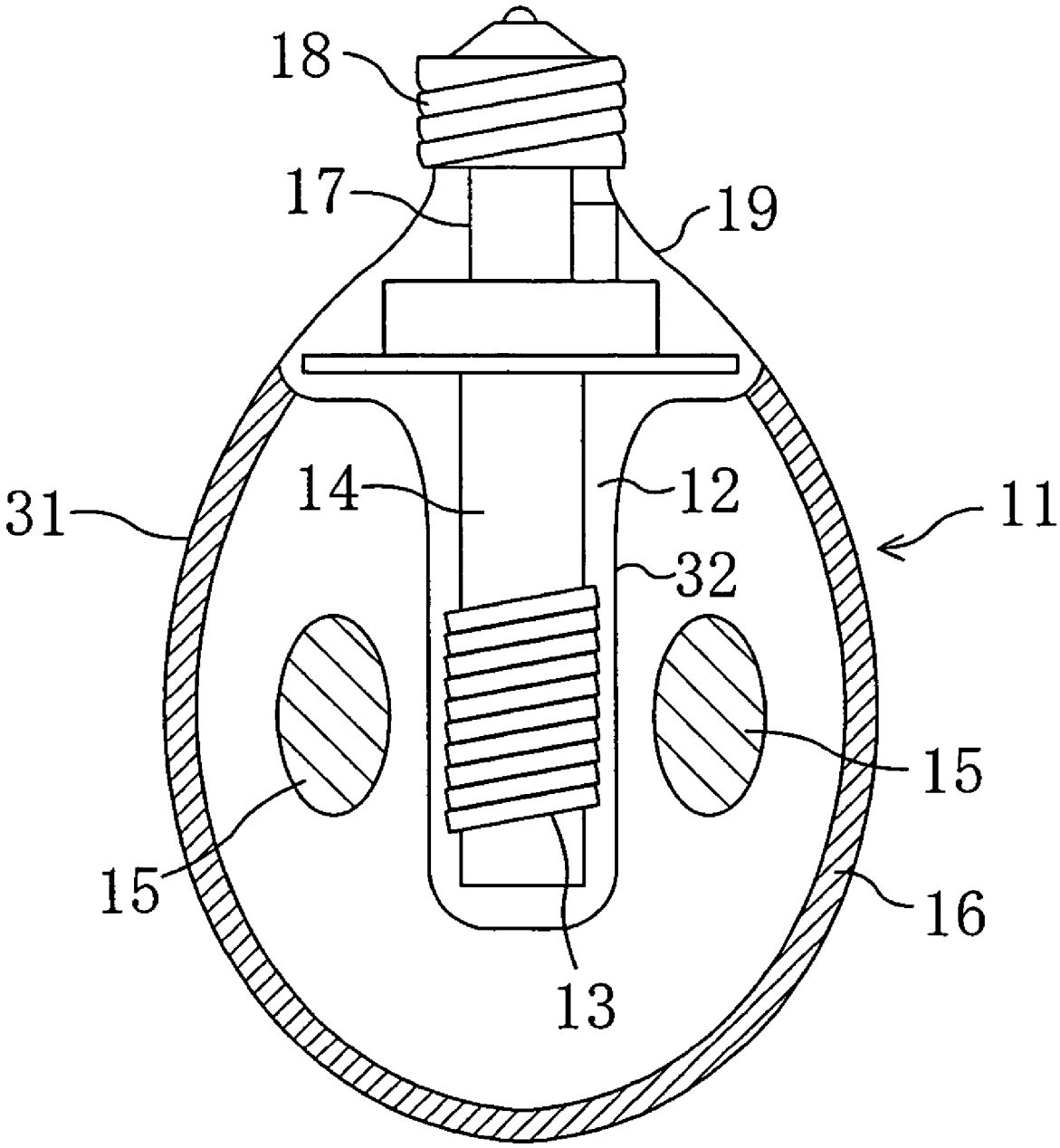
FIG. 8 is a cross-sectional view schematically illustrating the known incandescent-lamp-substituting electrodeless fluorescent lamp.

The luminous intensity distribution characteristics of the compact self-ballasted fluorescent lamp of this embodiment including the luminophor film 16' with the above-described film thickness distribution are as shown in FIG. 7, and can be made substantially the same as those of the silica incandescent lamp of FIG. 8.

Note that the ratio between the respective thicknesses of different parts of the luminophor film 16' at the inside wall of the discharge vessel 11 can be set at an appropriate value based on the transmittance (film density) of a luminophor of the luminophor film to be used and the luminous efficiency of the luminophor.

A method for forming the luminophor film 16' of this embodiment will be described.

Figure 9A:
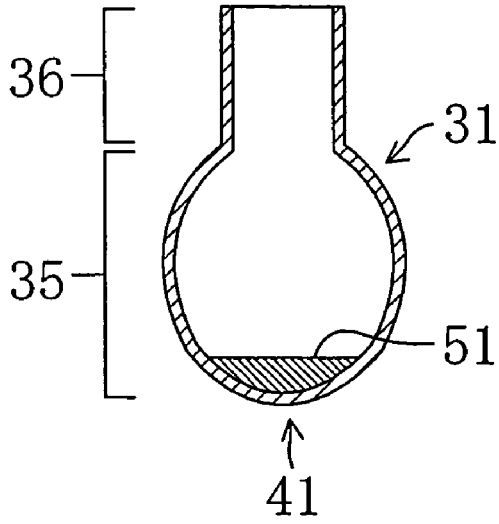
FIGS. 9(*a*) through 9(*b*) are cross-sectional views illustrating respective process steps for applying a luminophor film in the embodiment of the present invention.
Figure 9B:
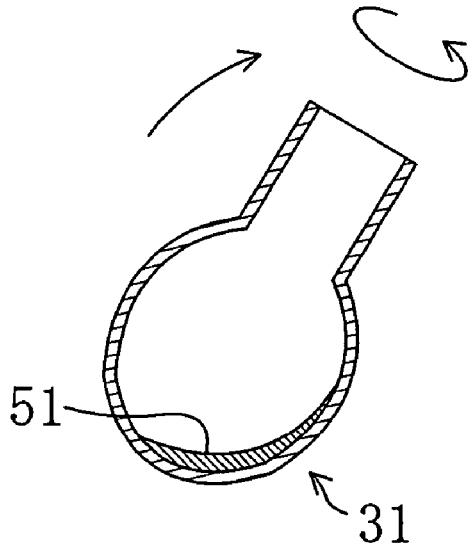
Figure 9C:
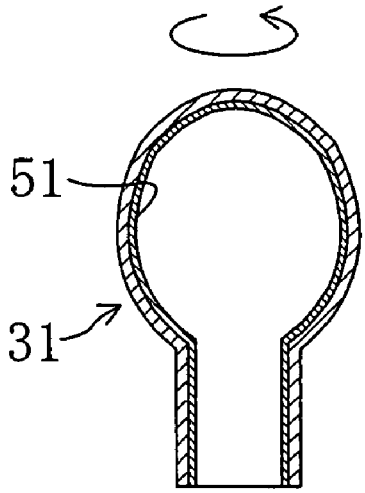

First, as shown in FIG. 9(*a*), a discharge vessel 11 including only an outer tube 31 is prepared. The outer tube 31 has a round flask like shape in which a neck portion 36 is connected to a body portion 35. The neck portion 36 has an opening at an edge portion thereof and a slurry 51 obtained by mixing a luminophor powder, a binder and a solvent is poured into the outer tube 31 from the opening.

Next, being set with a round bottom portion 41 at the lower edge and with the neck portion 36 up, as shown in FIG. 9(*a*), the outer tube 31 is rotated around the center axis of the neck portion 36 while the outer tube 31 is gradually tilted so that the neck portion finally comes down.

As shown in FIG. 9(*c*), when an opening edge portion of the neck portion 36 faces down and an excessive portion of the luminophor slurry 51 has flown downward, rotation of the outer tube 36 around the center axis is stopped and then the outer tube 36 is dried from both of the inside and outside thereof In this manner, the luminophor film 16' is formed.

Thus, the outer tube 31 is rotated around the center axis of the neck portion 36 while being tilted, and thereby a luminophor film 16' with the above-described film thickness distribution can be obtained. By changing the viscosity, rotating speed, tilting speed, and the like of the slurry 51, a desired film thickness distribution can be obtained.

If the electrodeless compact self-ballasted fluorescent lamp of this embodiment is connected to a lighting fixture for a downlight and used, the brightness of a lamp edge thereof is approximately the same as that of the periphery of the lamp edge. Thus, the electrodeless compact self-ballasted fluorescent lamp can be used with no apparent unpleasantness. Moreover, if the electrodeless compact self-ballasted fluorescent lamp of this embodiment is connected, with its base down, to a table lamp having a truncated cone shaped shade fixed around a lamp and used, light is emitted and reflected downward in the same manner as that in the case of an incandescent lamp. Thus, the electrodeless compact self-ballasted fluorescent lamp is comfortably used.

In the electrodeless fluorescent lamp of this embodiment, the luminous intensity distribution characteristics of the lamp can be controlled by controlling the thickness distribution of the luminophor film 16'. Thus, the electrodeless fluorescent lamp can be made to have substantially the same luminous intensity distribution characteristics as those of an incandescent lamp. Accordingly, even if the electrodeless fluorescent lamp is connected to an incandescent lamp lighting fixture, unpleasantness is not caused and efficiency in taking light out can be improved. Therefore, the electrodeless fluorescent lamp is useful for substituting an incandescent lamp. Moreover, since the method for applying the luminophor film 16' is a simple method in which the discharge vessel 11 is rotated while being tilted, the electrodeless fluorescent lamp can be fabricated in a simple manner.

This embodiment is an example of the present invention and the present invention is not limited thereto. For example, a luminophor may be a different substance from the substance described above. The blue luminophor for controlling a color temperature does not have to be added.

Moreover, incandescent lamps includes ball shaped incandescent lamps, reflex incandescent lamps, which are different from silica incandescent lamps. The luminous intensity distribution characteristics of the electrodeless fluorescent lamp can be approximated to those of lamps other than silica incandescent lamps by optimizing the thickness of the luminophor film 16'.

Moreover, it is preferable that the ring shaped plasma 15 is located in part of the discharge vessel 11 in which the diameter thereof is the maximum (i.e., part of the discharge vessel 11 in which a circle of an intersection line between a plane perpendicularly intersecting with the center axis of the coil 13 and the discharge vessel 11 has the maximum size) because a plasma can be efficiently generated, so that luminous efficiency can be improved.

Moreover, in this embodiment, the shape of the discharge vessel 11 is an A type shape. However, if the discharge vessel 11 has a P type shape defined in JIS C7710-1988: Designation Method for Glass Bulbs of Lamps or IEC 60887-1988, the same effect of improving the luminous intensity distribution characteristics can be obtained.

Note that it is preferable to use as the ballast circuit 17, a circuit in which a relatively low frequency, i.e., 1 MHz or less (e.g., 40–500 kHz)), is generated. In other words, the frequency of alternating current applied to the coil 13 by the ballast circuit 17 is preferably in a relatively low frequency region, i.e., at 1 MHz or less (e.g., 40–500 kHz). This is because, compared to the case where operation is performed at a frequency in a relatively high frequency region, i.e., at 13.56 MHz or several MHz, when operation is performed at a frequency in a frequency region of about 40 kHz to 1 MHz, low-cost, widely-used electronic parts for general electronic apparatuses can be used as members constituting a high frequency power circuit and also members with a small size can be used. Accordingly, reduction in cost and size can be achieved, resulting in great advantages. However, the structure of this embodiment is not limited to operations at 1 MHz or less, but can be also operated in a frequency region of 13.56 MHz or several MHz.

Moreover, in this embodiment, the core 14 is used. However, without the core 14, the luminous principle on which the electrodeless fluorescent lamp is based is not changed basically. Thus, the same effect of improving characteristics of luminous intensity distribution can be obtained. Note that if the core 14 is used, a plasma can be generated efficiently even with an alternating current in a relatively low frequency region, i.e., at 40 kHz to 1 MHz. Therefore, use of the core 14 is preferable.

Moreover, in this embodiment, as a light emitting substance, a light emitting substance in which a noble gas and mercury are enclosed is used. However, if discharge is induced using only a noble gas containing xenon as a main component and no mercury, the luminous principle on which the electrodeless fluorescent lamp is based is not changed basically. Therefore, the same effect of improving characteristics of luminous intensity distribution can be obtained by ultraviolet light irradiation from xenon.

-Effects-

As obvious from the description above, in the electrodeless fluorescent lamp of the present invention, as a luminophor film applied to the inside wall of a discharge vessel, a luminophor film having parts with different thicknesses depending on where the parts are applied is used. Thus, the luminous intensity distribution characteristics of the electrodeless fluorescent lamp can be approximated to those of the incandescent lamp. Therefore, efficiency in taking light out when the electrodeless fluorescent lamp is equipped to an incandescent lamp lighting fixture can be improved.

INDUSTRIAL APPLICABILITY

An electrodeless fluorescent lamp in accordance with the present invention is useful when being used as a substitute for an incandescent lamp. Specifically, when being connected to an incandescent lamp lighting fixture and used, the electrodeless fluorescent lamp of the present invention has approximately the same luminous intensity distribution characteristics as those of an incandescent lamp. Therefore, the electrodeless fluorescent lamp can be used with no unpleasantness. Furthermore, power consumption of the electrodeless fluorescent lamp is less than that of an incandescent lamp and the lifetime of the electrodeless fluorescent lamp is longer than that of an incandescent lamp. Therefore, the electrodeless fluorescent lamp has high industrial applicability in terms of power consumption and life.

What is claimed is:

1. An electrodeless fluorescent lamp characterized in that the electrodeless fluorescent lamp includes:

a translucent discharge vessel in which a light emitting substance is enclosed and which has a cavity portion;

a coil which is disposed in the cavity portion and generates an alternating electromagnetic field for inducing discharge of the light emitting substance; and a luminophor film formed on an inside wall of the discharge vessel, and the discharge vessel includes an outer tube and an inner tube, in the inner tube the cavity portion being defined, and the luminophor film has the maximum thickness in the vicinity of the intermediate point between a connection portion of the outer tube and the inner tube and part of the outer tube which is located most distant from the connection portion, and the thickness of part of the luminophor film tapers between the intermediate point and the connection portion, whereby the luminophor film has a predetermined luminous intensity distribution characteristics.

2. An electrodeless fluorescent lamp characterized in that the electrodeless fluorescent lamp includes:

a translucent discharge vessel in which a light emitting substance is enclosed and which has a cavity portion;

a coil which is disposed in the cavity portion and generates an alternating electromagnetic field for inducing discharge of the light emitting substance; and a luminophor film formed on an inside wall of the discharge vessel, and the coil has an approximately cylindrical shape, the discharge vessel includes an outer tube which includes a body potion and a neck portion having a reduced diameter and protruding from the body portion, and an inner tube in which the cavity portion is defined, the inner tube is connected to the neck portion and extends toward a round portion of the body portion which is located most distant from the neck portion, and the luminophor film has the maximum thickness in the vicinity of the intermediate point between a connection portion of the inner tube and the neck portion and the round bottom portion, and the thickness of part of the luminophor film tapers between the intermediate point and the connection portion, and also tapers between the intermediate point and the round bottom portion.

3. The electrodeless fluorescent lamp of claim 2 characterized in that the center axis of the coil extends in approximately the same direction as the direction in which the cavity portion caves in, and a plasma generated by the alternating electromagnetic field in the discharge vessel has a ring shape whose center point is a predetermined point located on the center axis of the coil and also in the coil.

4. The electrodeless fluorescent lamp of claim 2, characterized in that assuming that the maximum thickness of the luminophor film is 1, the thickness of part of the luminophor film located in the round bottom portion of the outer tube is not less than 0.1 and not more than 0.8, and the thickness of part of the luminophor film located in the vicinity of the connection portion with the inner tube is not less than 0.5 and not more than 0.8.

5. The electrodeless fluorescent lamp of claim 2, characterized in that the maximum thickness of the luminophor film is not less than 12 $\mu$m and not more than 24 $\mu$m, the thickness of part of the luminophor film located in the round bottom portion of the outer tube is not less than 7 $\mu$m and not more than 17 $\mu$m, and the thickness of part of the luminophor film located in the vicinity of the connection portion with the inner tube is not less than 8 $\mu$m and not more than 17 $\mu$m.

6. The electrodeless fluorescent lamp of claim 2, characterized in that the luminophor film has the maximum thickness in the vicinity of part of the outer tube in which a circle of an intersection line between a plane perpendicularly intersecting with the center axis of the coil and the outer tube has the maximum size.

7. The electrodeless fluorescent lamp of claim 2, characterized in that when the luminophor film is irradiated with ultraviolet light, in the relationship between the luminous intensity of radiation fluorescent light from the opposite surface of the luminophor film to the irradiated surface of the luminophor film and the thickness of the luminophor film, the maximum thickness of the luminophor film is larger than a thickness with which the luminous intensity is the maximum, and the average of the thickness of part of the luminophor film located in the round bottom and the average of the thickness of part of the luminophor film located in vicinity of the connection portion are smaller than a thickness with which the luminous intensity is the maximum.

8. The electrodeless fluorescent lamp of claim 1, characterized in that the shape of the discharge vessel is an A type shape or a P type shape defined in JIS C7710-1988: Designation Method for Glass Bulbs of Lamps or IEC 60887-1988.

9. The electrodeless fluorescent lamp of claim 2, characterized in that the shape of the discharge vessel is an A type shape or a P type shape defined in JIS C77 10-1988: Designation Method for Glass Bulbs of Lamps or IEC 60887-1988.

10. The electrodeless fluorescent lamp of claim 1, characterized by further comprising:

a core around which the coil is wound and which is made of ferrite;

a ballast circuit for supplying an alternating current to the coil to generate an alternating electromagnetic field;

a base which is electrically connected to the ballast circuit and receives power supply from the commercial power line; and a case which surrounds the ballast circuit and to which the discharge vessel and the base are attached.

11. The electrodeless fluorescent lamp of claim 2, characterized by further comprising:

a core around which the coil is wound and which is made of ferrite;

a ballast circuit for supplying an alternating current to the coil to generate an alternating electromagnetic field;

a base which is electrically connected to the ballast circuit and receives power supply from the commercial power line; and a case which surrounds the ballast circuit and to which the discharge vessel and the base are attached.

12. The electrodeless fluorescent lamp of claim 1, characterized by further comprising a lighting fixture which reflects light from the electrodeless fluorescent lamp.

13. The electrodeless fluorescent lamp of claim 2, characterized by further comprising a lighting fixture which reflects light from the electrodeless fluorescent lamp.

* * * * *